US008670012B2

(12) United States Patent
Mizutani et al.

(10) Patent No.: US 8,670,012 B2
(45) Date of Patent: Mar. 11, 2014

(54) ERASING APPARATUS AND ERASING METHOD

(75) Inventors: Kikuo Mizutani, Shizuoka-ken (JP); Isao Yahata, Shizuoka-ken (JP); Takahiro Kawaguchi, Shizuoka-ken (JP); Yoshiaki Sugizaki, Shizuoka-ken (JP); Ken Iguchi, Shizuoka-ken (JP); Hiroyuki Taki, Shizuoka-ken (JP); Hiroyuki Tsuchihashi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Yoichi Yamaguchi, Shizuoka-ken (JP); Hiroyuki Sugiyama, Shizuoka-ken (JP); Yuichi Saito, Shizuoka-ken (JP); Jun Ishii, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/528,542

(22) Filed: Jun. 20, 2012

(65) Prior Publication Data

US 2013/0002783 A1 Jan. 3, 2013

Related U.S. Application Data

(60) Provisional application No. 61/502,225, filed on Jun. 28, 2011, provisional application No. 61/533,169, filed on Sep. 9, 2011.

(30) Foreign Application Priority Data

May 16, 2012 (JP) ..... P2012-112043

(51) Int. Cl.
*B41J 2/32* (2006.01)

(52) U.S. Cl.
USPC ..... 347/179

(58) Field of Classification Search
USPC ..... 347/171, 179
See application file for complete search history.

(56) References Cited

U.S. PATENT DOCUMENTS 5,907,348 A * 5/1999 Ogasawara et al. ..... 347/212
6,152,620 A * 11/2000 Ozawa et al. ..... 400/120.01
6,384,378 B2 * 5/2002 Natsuhara et al. ..... 219/216

(Continued)

FOREIGN PATENT DOCUMENTS

JP 06-175538 6/1994
JP 07-047701 2/1995
JP 08-067021 3/1996

(Continued)

*Primary Examiner* — Huan Tran
(74) *Attorney, Agent, or Firm* — Patterson & Sheridan, L.L.P.

(57) ABSTRACT

According to one embodiment, an erasing apparatus includes a paper feeding unit configured to feed a sheet having an image recorded, an erasing unit including a pressing roller and a heater that has a shape following the outer circumference of the pressing roller and includes a contact area with the pressing roller, the erasing unit being configured to erase the image formed on the sheet fed to a contact section of the pressing roller and the heater from the paper feeding unit, a temperature detecting unit configured to detect the temperature of the heater, a controller configured to control the heater according to the temperature detected by the temperature detecting unit, and a paper discharge unit configured to discharge the sheet on which the image is erased by the erasing unit.

18 Claims, 8 Drawing Sheets

(56) References Cited

U.S. PATENT DOCUMENTS

| | | | | |
|---|---|---|---|---|
| 6,392,197 | B2 * | 5/2002 | Natsuhara et al. | 219/216 |
| 7,313,339 | B2 * | 12/2007 | Nishiyama | 399/68 |
| 8,428,498 | B2 * | 4/2013 | Fujiwara et al. | 399/328 |
| 2001/0054609 | A1 * | 12/2001 | Natsuhara et al. | 219/216 |
| 2002/0000431 | A1 * | 1/2002 | Natsuhara et al. | 219/216 |
| 2006/0104652 | A1 * | 5/2006 | Nishiyama | 399/68 |

FOREIGN PATENT DOCUMENTS

| | | |
|---|---|---|
| JP | 2001-159856 | 6/2001 |
| JP | 2006-178119 | 7/2006 |
| JP | 2009-023143 | 2/2009 |

* cited by examiner

ERASING APPARATUS AND ERASING METHOD

CROSS-REFERENCE TO RELATED APPLICATIONS

This application is based upon and claims the benefit of priorities from the prior U.S. patent applications Ser. No. 61/502,225, filed on Jun. 28, 2011, and Ser. No. 61/533,169, filed on Sep. 9, 2011, the entire contents all of which are incorporated herein by reference.

This application is also based upon and claims the benefit of priority from the prior Japanese Patent Application No. 2012-112043, filed on May 16, 2012, the entire contents all of which are incorporated herein by reference.

FIELD

Embodiments described herein relate generally to an erasing apparatus and an erasing method.

BACKGROUND

There are known a color erasing apparatus that applies erasing processing to a sheet with heat and erases a color of an image. The color erasing apparatus includes a pair of erasing units including rollers and heaters across a conveying path. However, in the color erasing apparatus, nip widths (contact areas) between the heaters and the rollers for applying heat to the sheet are small and the heat maybe unable to be efficiently transferred to the sheet.

DETAILED DESCRIPTION

Figure 1:
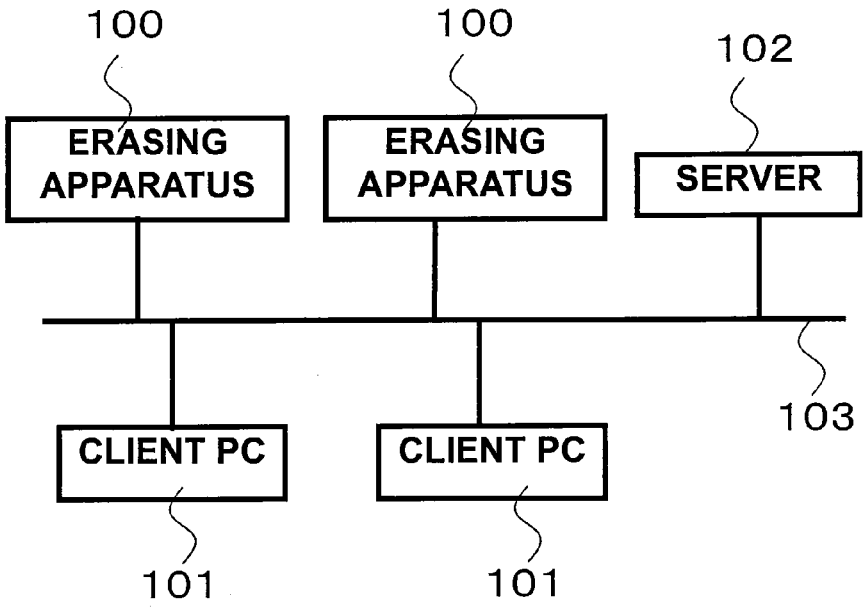
FIG. 1 is a system configuration diagram in a first embodiment.

In general, according to one embodiment, it is to provide an erasing apparatus including: a paper feeding unit configured to feed a sheet having an image recorded; an erasing unit including a pressing roller and a heater that has a shape following the outer circumference of the pressing roller and includes a contact area with the pressing roller, the erasing unit being configured to erase the image formed on the sheet fed to a contact section of the pressing roller and the heater from the paper feeding unit; a temperature detecting unit configured to detect the temperature of the heater; a controller configured to control the heater according to the temperature detected by the temperature detecting unit; and a paper discharge unit configured to discharge the sheet on which the image is erased by the erasing unit.

Embodiments will now be described in more detail with reference to the accompanying drawings. However, the same numerals are applied to the similar elements in the drawings, and therefore, the detailed descriptions thereof are not repeated.

First Embodiment

A color erasing apparatus (a decoloring apparatus) according to a first embodiment erases an image formed on a sheet using a heater that has a shape following a pressing roller.

FIG. 1 is a system configuration diagram in the first embodiment. The system configuration includes, for example, plural color erasing apparatuses 100, plural client PCs (Personal Computers) 101, and a server 102. The components of the system are connected to one another via a network 103 such as a LAN (Local Area Network).

Figure 2:
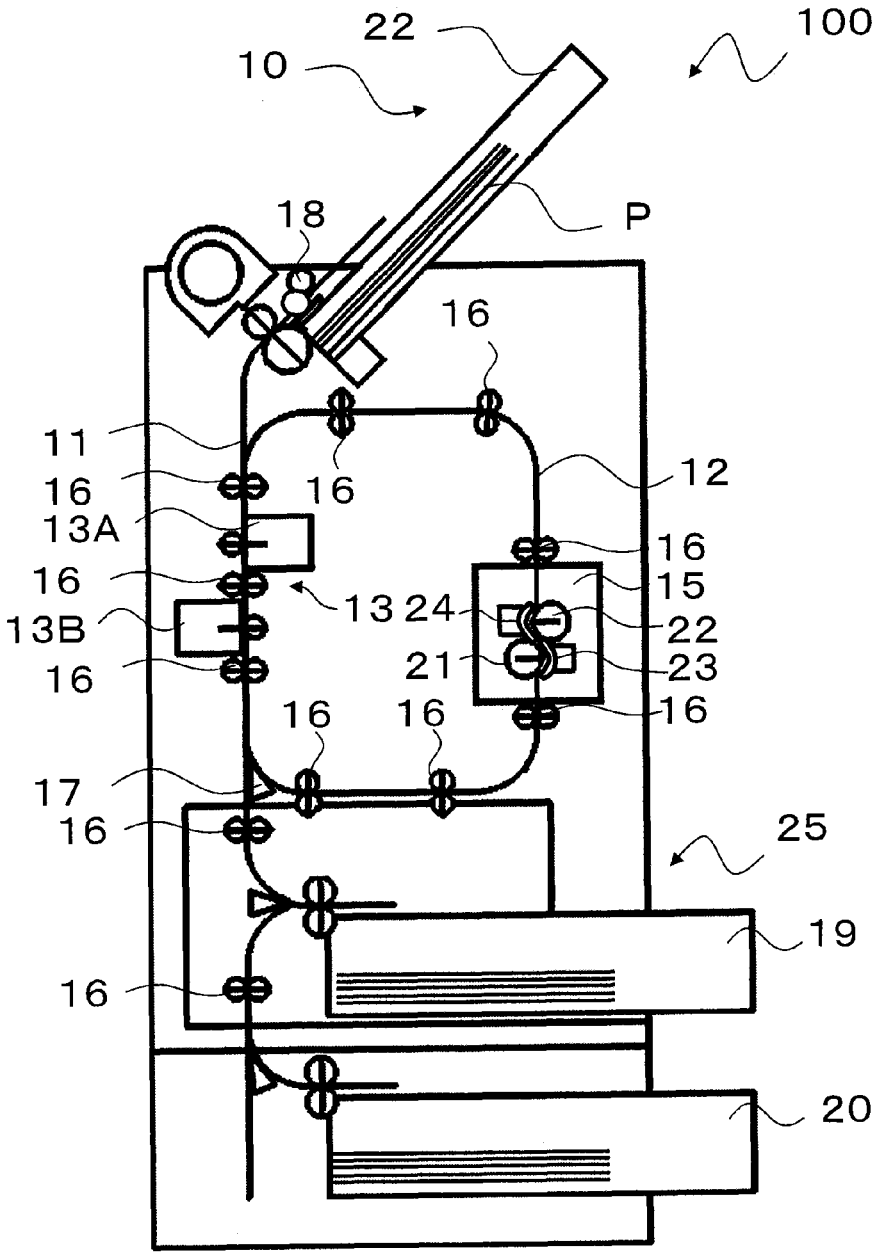
FIG. 2 is a configuration diagram of a color erasing apparatus in the first embodiment.

FIG. 2 is a configuration diagram of the color erasing apparatus. The color erasing apparatus 100 erases an image on a sheet (a recording medium) subjected to image formation by an image forming apparatus (not shown in the figure) and enables reuse of the sheet. The color erasing apparatus 100 includes a paper feeding unit 10, a first conveying path 11, a second conveying path 12, a first read unit 13A, a second read unit 13B, an erasing unit 15, conveying rollers 16, a path changing unit (switching unit) 17, a first paper discharge unit 19, and a second paper discharge unit 20.

The paper feeding unit 10 stores plural sheets P having images formed thereon. In order to erase the images on the sheets P to be reused, the paper feeding unit 10 feeds the sheets P to the inside of the color erasing apparatus 100. The paper feeding unit 10 includes a paper feeding tray 22 and a pickup roller 18. The pickup roller 18 picks up the sheets P from the paper feeding tray 22 one by one and delivers the sheet P to the first conveying path 11.

Each of the first conveying path 11 and the second conveying path 12 includes plural conveying rollers 16. Each of the conveying rollers 16 includes a pair of a driving roller and a driven roller. In the first conveying path 11, a pair of first and second read units 13A and 13B (collectively referred to as read unit 13) are arranged, so to speak, alternately across the first conveying path 11. The first read unit 13A and the second read unit 13B basically have the same configuration and respectively include two-dimensional CCD scanners. The first read unit 13A and the second read unit 13B are not limited to the two-dimensional scanners and my include CMOS sensors. The first read unit 13A reads one surface of the sheet P conveyed from the paper feeding unit 10. The second read unit 13B reads a surface on the opposite side of the surface read by the first read unit 13A. Images read by the first read unit 13A and the second read unit 13B are stored in a storage unit 202 shown in FIG. 3. The storage unit 202, which is a storage destination of the images read by the first read unit 13A and the second read unit 13B, is a semiconductor or mechanical (magnetic) memory such as a ROM (Read Only Memory), a RAM (Random Access Memory), or a HDD (Hard Disk Drive).

The images read by the first read unit 13A and the second read unit 13B do not always have to be stored in the storage unit 202 of the color erasing apparatus 100 and may be stored in a storage unit 302 (see FIG. 3) of the client PC 101 or a storage unit 402 (see FIG. 3) of the server 102. If the color erasing apparatus 100 includes a log-in and long-out function in order to personally authenticate a user, when the user logs out from the color erasing apparatus 100, image data stored in the storage unit 202 of the color erasing apparatus 100 may be transmitted to the storage unit 302 of the client PC 101 or the storage unit 402 of the server 102 and stored therein.

The user can read out the images, which are read by the read unit 13 and stored, from the storage unit 202, 302, or 402 and view the images. When the user selects an image that the user views, a controller 200 of the color erasing apparatus 100 shown in FIG. 3 explained below causes a display section 209 of the color erasing apparatus 100 to display the selected image. Display of the image is not limited to the display on the display section 209 of the color erasing apparatus 100 and may be display on a display section 304 of the client PC 101 shown in FIG. 3.

The first read unit 13A and the second read unit 13B read the surfaces of the sheet P in order to determine whether the sheet P is usable and whether printing on the sheet P is erased.

Therefore, the first read unit 13A and the second read unit 13B perform the reading twice. In the first reading, the controller 200 changes read images into an electronic form and stores the images in the storage unit 202. The first reading is performed before erasing and the second reading is performed after the erasing. In the second reading, the controller 200 determines whether the sheet P is reusable after erasing processing.

In the first reading, the controller 200 may store the images and determine whether the sheet P is unreusable because of creases, a staple, a bend, an unerasable memorandum, or the like. In this case, if it is determined in the first reading that the sheet P is in a reusable state, the controller 200 applies the erasing processing to the sheet P. In the second reading, controller 200 determines whether the images on the sheet P are erased. The controller 200 discharges the sheet P to the first paper discharge unit 19 or the second paper discharge unit 20. If it is determined in the first reading that the sheet P is in an unreusable state, the controller 200 applies the erasing processing to the sheet P. The controller 200 discharges the sheet P to the first paper discharge unit 19 or the second paper discharge unit 20 without applying the performing the second reading. If it is determined in the first reading that the sheet P is in the unreusable state, the controller 200 may discharge the sheet P to the first paper discharge unit 19 or the second paper discharge unit 20 without performing the erasing processing and the second reading. The reading, the determination, the erasing processing, and the paper discharge can be selected and set beforehand.

The controller 200 may determine, in the reading after the erasing, whether the sheet P is unreusable because of creases, a staple, a bend, an unerasable memorandum, or the like. If the reading is performed after the erasing, it is easy to detect creases, a staple, a bend, an unerasable memorandum, or the like. For example, the controller 200 determines, in the reading after the erasing, whether the sheet P is unreusable because of creases, a staple, a bend, an unerasable memorandum, or the like and discharges, according to a determination result, the sheet P to the first paper discharge unit 19 or the second paper discharge unit 20. The reading, the determination, and the paper discharge can be selected and set beforehand.

As shown in FIG. 2, the first conveying path 11 is connected from the paper feeding unit 10 to the first paper discharge unit 19 or the second paper discharge unit 20. The second conveying path 12 branches from a branch point downstream of the first read unit 13A and the second read unit 13B in the first conveying path 11 and merges at a merging point upstream of the first read unit 13A and the second read unit 13B in the first conveying path 11. The path changing unit 17 is arranged at the branch point. Therefore, the sheet P picked up from the paper feeding unit 10 is conveyed through the first conveying path 11, the path changing unit 17, and the second conveying path 12 and reaches the first conveying path 11 again.

The erasing unit 15 is arranged in the second conveying path 12. The erasing unit 15 is explained below.

As shown in FIG. 2, a paper discharge unit 25 includes the first paper discharge unit 19 and the second paper discharge unit 20. The controller 200 controls conveying rollers 16, subject the sheet to the first paper discharge unit 19 or the second paper discharge unit 20. The user may be allowed to select the first paper discharge unit 19 or the second paper discharge unit 20 such that the sheet P can be discharged thereto. For example, the first paper discharge unit 19 and the second paper discharge unit 20 may be set to respectively store reusable sheets and the unreusable sheets.

Figure 3:
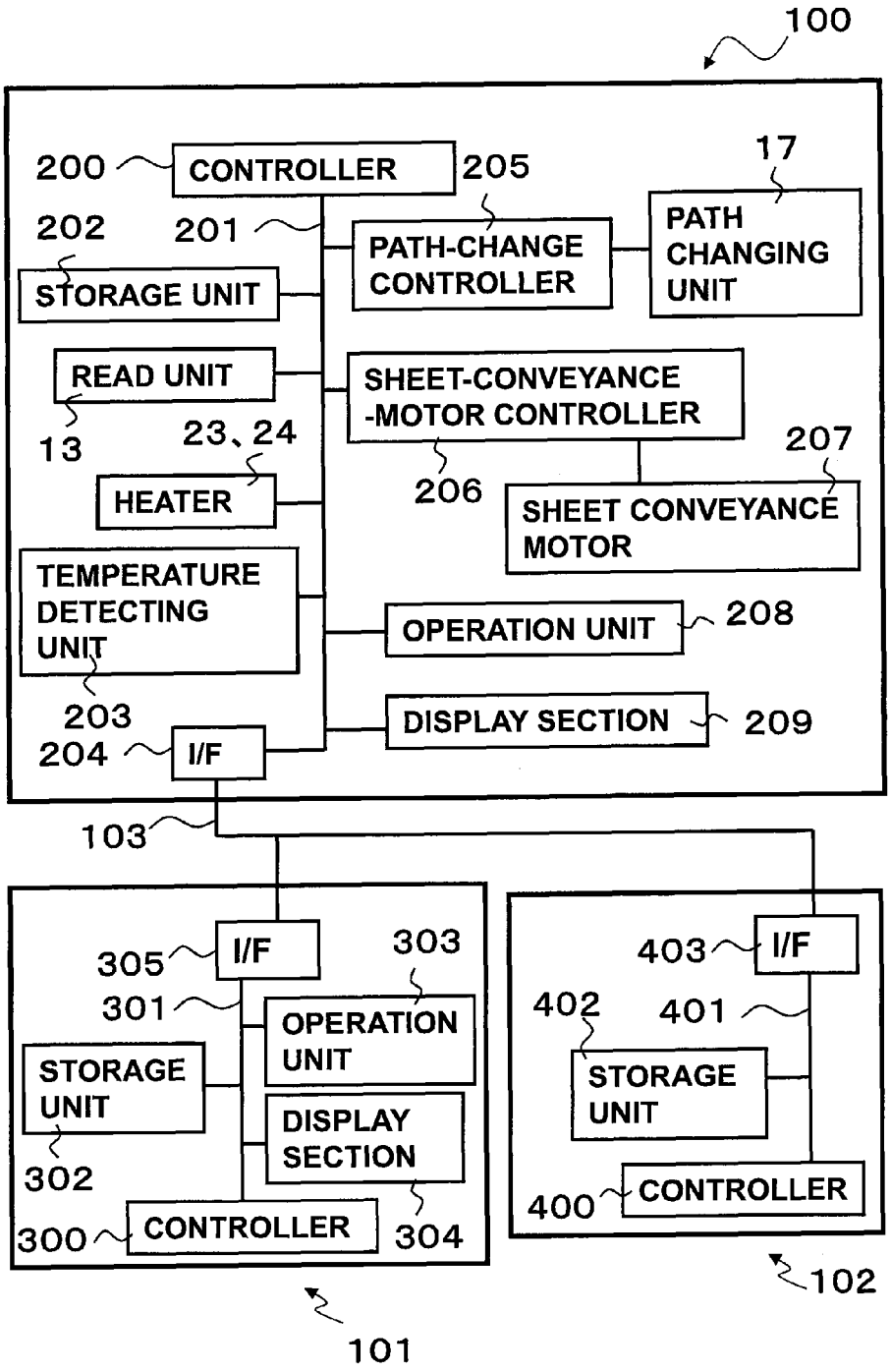
FIG. 3 is a block diagram of the color erasing apparatus, a client PC, and a server in the first embodiment.

FIG. 3 is a block diagram of the color erasing apparatus 100, the client PC 101, and the server 102. The color erasing apparatus 100 includes the controller 200, the storage unit 202, the read unit 13, heaters 23 and 24, the temperature detecting unit 203, a communication I/F (interface) 204, a path-change controller 205 that controls the path changing unit 17, a sheet-conveyance-motor controller 206 that controls a sheet conveyance motor 207 that drives the conveying rollers, an operation unit 208, and the display section 209. The controller 200 is connected to the storage unit 202, the read unit 13, the heaters 23 and 24, the temperature detecting unit 203, the communication I/F 204, the path-change controller 205, the sheet-conveyance-motor controller 206, the operation unit 208, and the display section 209 via a system bus 201. The controller 200 communicates, using the communication I/F 204 connected via the system bus 201, the client PC 101 and the server 102 via the network 103.

The controller 200 includes, for example, a CPU (Central Processing Unit), a ROM, and a RAM. In the ROM, a computer program for causing the controller 200 to operate, a printing ratio of a sheet for determining reusability, and a density threshold for determining whether an image is erased are stored. If the depth of creases or the like is determined in the first image reading, a density threshold used for determining the depth of the creases or the like is stored. In the RAM, images obtained during image reading of the sheet P are stored. The read unit 13 is, for example, a CCD sensor and is arranged as a row of line sensors. The read unit 13 detects light and shade of the sheet P. As the heaters 23 and 24, planar heaters or the like are used. While the sheet P passes through the erasing unit 15, the heaters 23 and 24 apply heat to the sheet P and decolor a color material.

The controller 200 controls the path-change controller 205 to thereby drive the path changing unit 17. The path changing unit 17 diverts the sheet P to be conveyed from the first conveying path 11 to the second conveying path 12 and diverts the sheet P to be conveyed from the first conveying path 11 to the first paper discharge unit 19 and the second paper discharge unit 20. The controller 200 discriminates, after image erasing, whether the erasing is normally applied, i.e., whether the sheet Pis reusable. Further, the controller 200 detects the temperature of the heaters 23 and 24 via the temperature detecting unit 203 and controls the temperature of the heaters 23 and 24 to a predetermined value.

The operation unit 208 includes the display section 209 of a touch panel type and various keys. The operation unit 208 is arranged in, for example, an upper part of the main body of the color erasing apparatus 100. The various keys include, for example, a ten key, a stop key, and a start key. The display section 209 displays setting information including various processing mode, an operation status, and log information of the color erasing apparatus 100 or a message to the user. The user can select, via the operation unit 208, a processing mode such as a start of the erasing processing or reading of images on the sheet P to be erased displayed on the display section 209 of the color erasing apparatus 100. The operation unit 208 is not limited to be arranged in the main body of the color erasing apparatus 100. For example, the operation unit 208 may be configured to be capable of being operated from an operation unit of an external apparatus connected to the color erasing apparatus 100 via a network. Alternatively, the operation unit 208 may be separated from the main body of the color erasing apparatus 100 and configured to operate the color erasing apparatus 100 through wired or wireless communication. The operation unit in this embodiment only has to be an operation unit with which, for example, the user can give an instruction of processing to the color erasing apparatus 100 and view information. In the following explanation, the display section 209 is explained as a touch panel.

The client PC 101 shown in FIG. 3 includes a controller 300, a storage unit 302, an operation unit 303, a display section 304, and a communication I/F 305. The controller 300 of the client PC 101 includes, for example, a CPU, a ROM, and a RAM. The controller 300 is connected to the storage unit 302, the operation unit 303, the display section 304, and the communication I/F 305 via a system bus 301.

The server 102 shown in FIG. 3 includes a controller 400, a storage unit 402, and a communication I/F 403. The controller 400 of the server 102 includes, for example, a CPU, a ROM, and a RAM. The controller 400 is connected to the storage unit 402 and the communication I/F 403 via a system bus 401.

Figure 4:
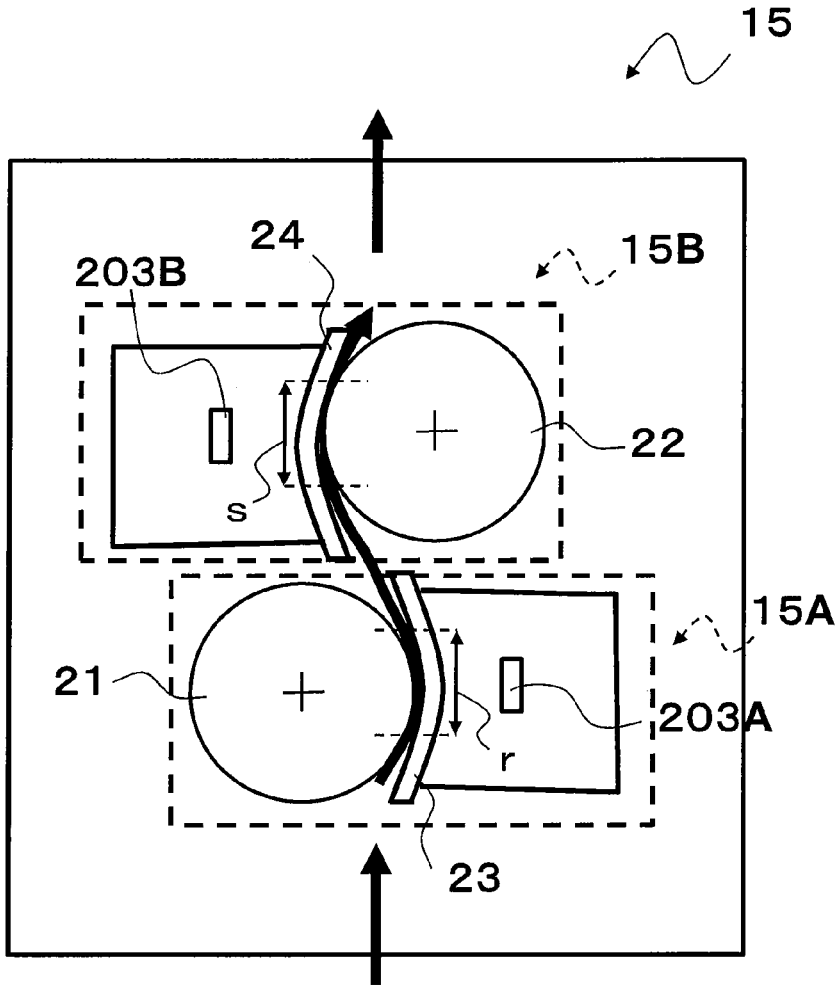
FIG. 4 is an enlarged diagram of an erasing unit in the first embodiment.

FIG. 4 is an enlarged diagram of the erasing unit 15. The erasing unit 15 includes a first erasing unit 15A and a second erasing unit 15B in order to erase images on both the surfaces of the sheet P. In FIG. 4, a conveying direction of the sheet P is a down to up direction as indicated by an arrow. The second erasing unit 15B is located downstream in the conveying direction of the sheet P from the first erasing unit 15A.

The first erasing unit 15A includes a first pressing roller 21, a first heater 23, and a temperature detecting unit 203A. The first heater 23 is arranged in a position opposed to the first pressing roller 21 across a conveying path. The first heater 23 has a shape following the outer circumference of the first pressing roller 21. The first heater 23 has a concave shape, which is a shape that covers a part of the outer circumference of the first pressing roller 21. The first pressing roller 21 has high hardness compared with the first heater 23. When the sheet P passes between the first pressing roller 21 and the first heater 23 in the arrow direction, the first pressing roller 21 pressed the sheet against the heater 23. Specifically, pressure is applied to the sheet P by the first pressing roller 21 and heat is applied to the sheet P by the first heater 23. At this point, the heat is transferred to the sheet P. An image formed on the surface of the sheet P in contact with the first heater 23 is erased. The controller 200 causes the first pressing roller 21 and the heater 23 to apply pressure and heat equal to or higher than fixed pressure and fixed heat to the sheet P to thereby heat an image on the sheet P formed with an erasable image forming material and decolor the color material.

The temperature detecting unit 203A detects the heat (temperature) of the first heater 23. The temperature detecting unit 203A desirably detects the temperature of a position where a nip portion r is formed by the first pressing roller 21 and the first heater 23.

The second erasing unit 15B includes a second pressing roller 22, a second heater 24, and a temperature detecting unit 203B. The second heater 24 is arranged in a position opposed to the pressing roller 22 across the conveying path. The second heater 24 has a shape following the outer circumference of the second pressing roller 22. Specifically, the second heater 24 has a shape that covers a part of the outer circumference of the second pressing roller 22. The second pressing roller 22 has high hardness compared with the second heater 24. When the sheet P passes between the second pressing roller 22 and the second heater 24, the sheet P is pressed against the second heater 24 by the second pressing roller 22. Specifically, pressure is applied to the sheet P by the second pressing roller 22 and heat is applied to the sheet P by the second heater 24. At this point, the heat is transferred to the sheet P and an image formed on the surface of the sheet P in contact with the second heater 24 is erased. The controller 200 causes the second pressing roller 22 and the second heater 24 to apply pressure and heat equal to or higher than fixed pressure and fixed heat to thereby heat an image on the sheet P formed with an erasable color forming material and decolor the color material. As shown in FIG. 4, the second erasing unit 15B erases an image on the surface opposite to the surface of the sheet P erased by the first erasing unit 15A.

Since the first heater 23 and the second heater 24 are formed in the shapes following the first pressing roller 21 and the second pressing roller 22, it is possible to secure wide or long nip widths between the first and second heaters 23 and 24 and the first and second pressing rollers 21 and 22 for applying heat to the sheet P. Since the nip widths between the first and second heaters 23 and 24 and the first and second pressing rollers 21 and 22 are secured, it is possible to efficiently transfer heat to the sheet P and save electric power.

The temperature detecting unit 203B detects the heat of the heater 24. The temperature detecting unit 203B desirably detects the temperature of a position where a nip portion s is formed by the pressing roller 22 and the heater 24.

The first heater 23 and the second heater 24 respectively have the shapes following the first pressing roller 21 and the second pressing roller 22 corresponding thereto. Therefore, as the first heater 23 and the second heater 24, flexibly moving heaters are desirable. The first heater 23 and the second heater 24 are, for example, planar heaters formed by using a resin film or natural mica. The first heater 23 and the second heater 24 may be heaters formed by inserting heating wires through ceramic glass and braiding the heating wires as long as the heaters are flexibly moving heaters. The first heater 23 and the second heater 24 are not in direct contact with the first pressing roller 21 and the second pressing roller 22 or the sheet P. Heat transfer members such as aluminum plates are placed between the first and second heaters 23 and 24 and the first and second pressing rollers 21 and 22 or the sheet P. It is possible to uniformly heat the sheet P by transferring the heat from the first heater 23 and the second heater 24 to the sheet P via the aluminum plates.

The erasing unit 15 includes the second erasing unit 15B including the second pressing roller 22 and the second heater 24, the positions of which are reversed from the positions of the first pressing roller 21 and the first heater 23 of the first erasing unit 15A. By arranging the pressing rollers 21 and 22 and the heaters 23 and 24 in this way, images on both the surfaces of the sheet P are erased in one sheet conveyance.

The first heater 23 has the shape following the first pressing roller 21. The second heater 24 has the shape following the second pressing roller 22. Therefore, the pressing rollers 21 and 22 and the heaters 23 and 24 of the first erasing unit 15A and the second erasing unit 15B are arranged in positions shifted in the horizontal direction such that the sheet P passing between the pressing rollers 21 and 22 and the heaters 23 and 24 is conveyed while drawing an S curve (wavy line). In other words, a lead-out direction of the sheet P from the first erasing unit 15A and an entering direction of the sheet P into the second erasing unit 15B are set the same. The conveying rollers 16 convey the sheet P downward in the conveying direction from the first erasing unit 15A first enters the nip portion between the first heater 23 and the pressing roller 21. The first heater 23 guides the sheet P, and lead out the sheet P from the first erasing unit 15A while being tilted at a certain angle with respect to the vertical direction. The sheet P enters the nip portion between the second heater 24 and the pressing roller 22 of the second erasing unit 15B while being kept on tilted at the angle. The second heater 24 guides the sheet P, and conveys the sheet P downstream in the conveying direction from the second erasing unit 15B while being tilted at a certain angle with respect to the vertical direction. Since the pressing rollers 21 and 22 and the heaters 23 and 24 are arranged in the positions as explained above, it is possible to smoothly convey the sheet P while securing wide and long contact areas of the nip portions between the heaters 23 and 24 and the pressing rollers 21 and 22 for applying heat to the sheet P.

In FIG. 4, the left side of the first erasing unit 15A is the first pressing roller 21 and the right side of the first erasing unit 15A is the first heater 23. The left side of the second erasing unit 15B is the second heater 24 and the right side of the second erasing unit 15B is the second pressing roller 22. However, this is not a limitation. The right side of the first erasing unit 15A may be the first pressing roller 21 and the left side of the first erasing unit 15A may be the first heater 23. The right side of the second erasing unit 15B may be the second heater 24 and the left side of the second erasing unit 15B may be the second pressing roller 22.

Figure 5:
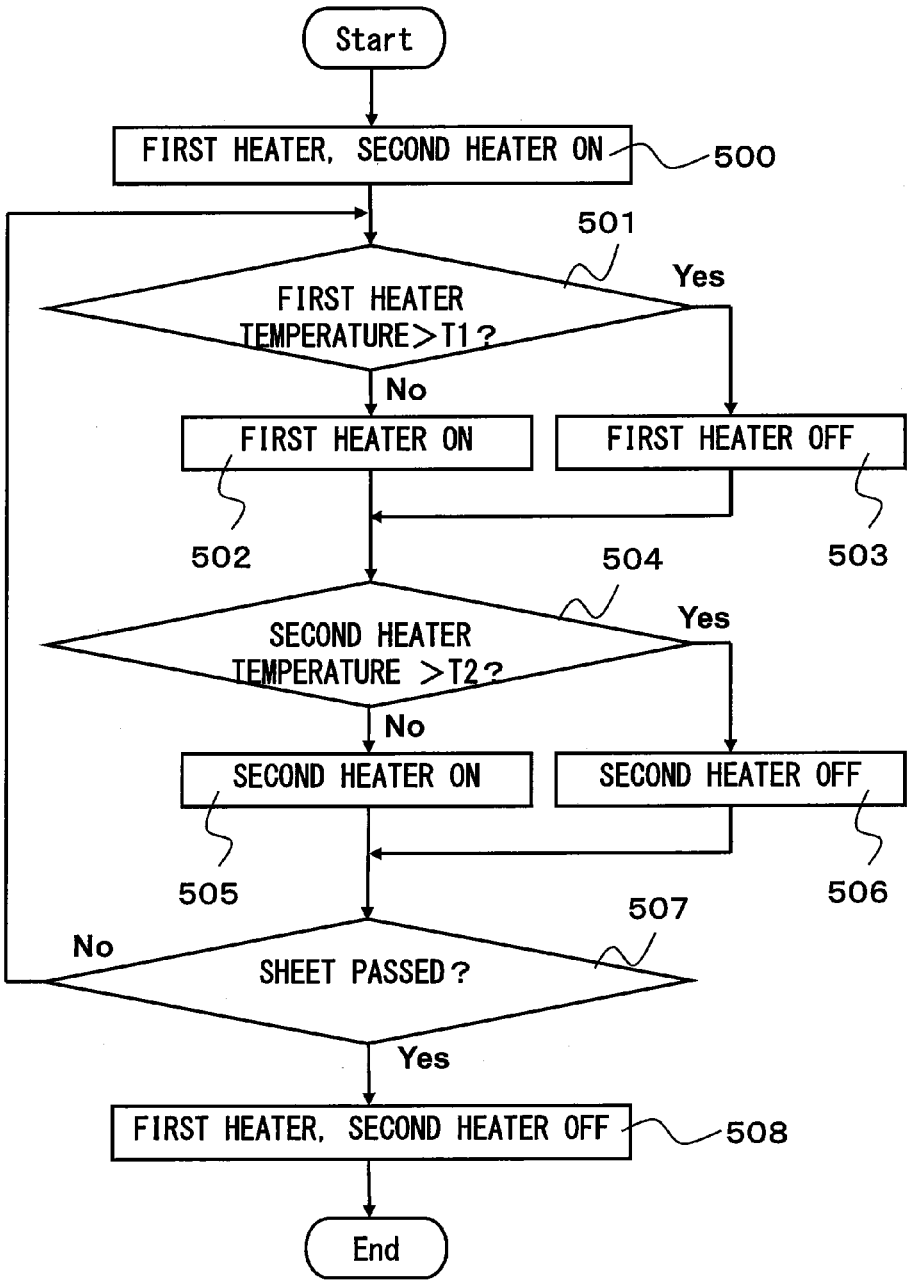
FIG. 5 is a flowchart for explaining temperature control for heaters in the first embodiment.

Temperature control for the heaters 23 and 24 of the first and second erasing units 15A and 15B is explained with reference to FIG. 5. FIG. 5 is a flowchart for explaining the temperature control for the heaters 23 and 24. In Act 500, the controller 200 turns on the first heater 23 and the second heater 24. In Act 501, the controller 200 determines whether the temperature of the first heater 23 is higher than a threshold T1. If the controller 200 determines that the temperature of the first heater 23 is not higher than the threshold T1 (No in Act 501), in Act 502, the controller 200 maintains the first heater 23 on and proceeds to Act 504. On the other hand, if the controller 200 determines that the temperature of the first heater 23 is higher than the threshold T1 (Yes in Act 501), in Act 503, the controller 200 turns off the first heater 23 and proceeds to Act 504.

In Act 504, the controller 200 determines whether the temperature of the second heater 24 is higher than a threshold T2. If the controller 200 determines that the temperature of the second heater 24 is not higher than the threshold T2 (No in Act 504), in Act 505, the controller 200 maintains the second heater 24 on and proceeds to Act 507. On the other hand, if the controller 200 determines that the temperature of the second heater 24 is higher than the threshold T2 (Yes in Act 504), in Act 506, the controller 200 turns off the second heater 24 and proceeds to Act 507.

In Act 507, the controller 200 determines whether the sheet P finishes passing through the first erasing unit 15A and the second erasing unit 15B. If the controller 200 determines that the sheet P does not finish passing through the first erasing unit 15A and the second erasing unit 15B (No in Act 507), the controller 200 returns to Act 501 and continues the processing. On the other hand, if the controller 200 determines that the sheet P finishes passing through the first erasing unit 15A and the second erasing unit 15B (Yes in Act 507), the controller 200 proceeds to Act 508, turns off the first heater 23 and the second heater 24, and ends the erasing processing.

In the above explanation, the erasing unit 15 includes the first erasing unit 15A and the second erasing unit 15B and erases the images on both the surfaces of the sheet P at one time. However, this is not a limitation. For example, only one set of erasing unit including a pressing roller and a heater maybe provided. If the erasing unit is used, after one surface of the sheet P is erased, the sheet P is reversed and the other surface of the sheet P not subjected to erasing processing is erased.

With the color erasing apparatus and the erasing method according to the first embodiment explained above, the wide and long contact areas of the nip portions between the heaters 23 and 24 and the pressing rollers 21 and 22 are secured. Consequently, it is possible to efficiently transfer heat to the sheet P and save electric power.

Second Embodiment

In an color erasing apparatus according to a second embodiment, the shape of heaters changes between during contact and during separation of pressing rollers and the heaters. Components same as those in the first embodiment are denoted by the same reference numerals and signs.

Figure 6:
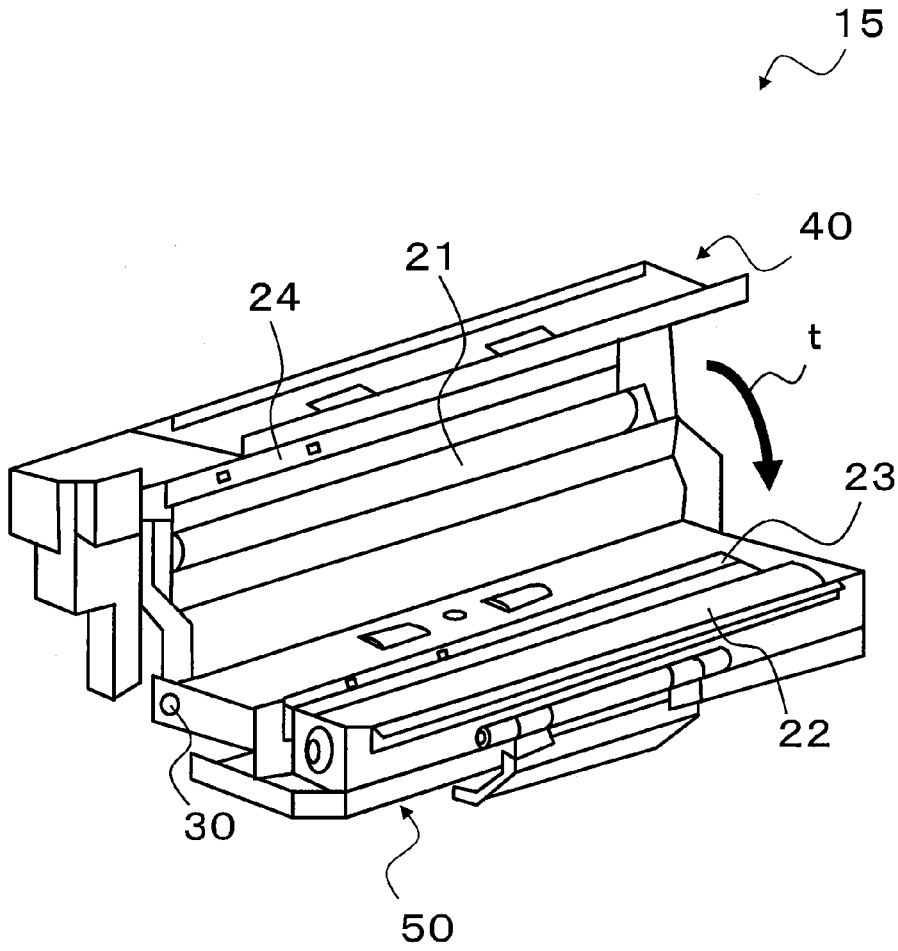
FIG. 6 is a perspective view of an opened erasing unit in a second embodiment.

FIG. 6 is a schematic perspective view of the opened erasing unit 15. The erasing unit 15 includes a fixed unit 40 and a movable unit 50. The movable unit 50 pivots about a pivot shaft 30. When a jammed sheet P in the erasing unit 15 is removed, the movable unit 50 is pivoted in an arrow "t" direction to open the erasing unit 15. As shown in FIG. 6, when a jam occurs, the sheet P can be removed by opening the erasing unit 15. After removing the jammed sheet P, a user pivots the movable unit 50 is a direction opposite to the arrow "t" direction and brings the first pressing roller 21 into contact with the first heater 23 and brings the second pressing roller 22 into contact with the second heater 24.

The fixed unit 40 includes the first pressing roller 21, the second heater 24, and the temperature detecting unit 203B. The movable unit 50 includes the first heater 23, the temperature detecting unit 203A, and the second pressing roller 22. When the erasing unit 15 is opened, the first pressing roller 21 and the first heater 23 separate from each other and the second pressing roller 22 and the second heater 24 also separate from each other. During erasing processing, the first pressing roller 21 and the first heater 23 come into contact with each other and the second pressing roller 22 and the second heater 24 also come into contact with each other.

Figure 7:
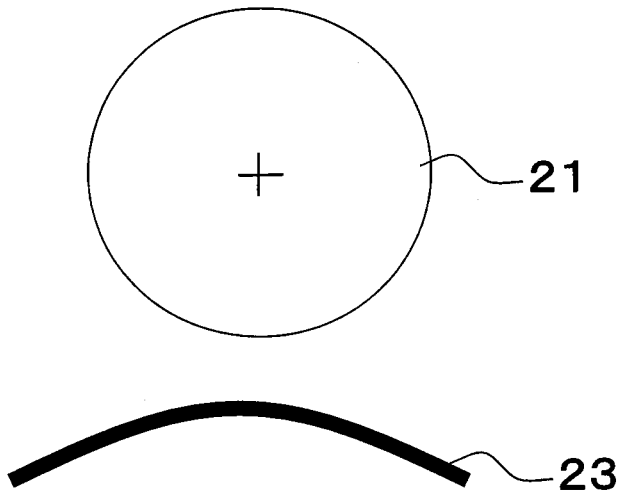
FIG. 7 is a diagram of a separated state of a pressing roller and a heater in the second embodiment.
Figure 8:
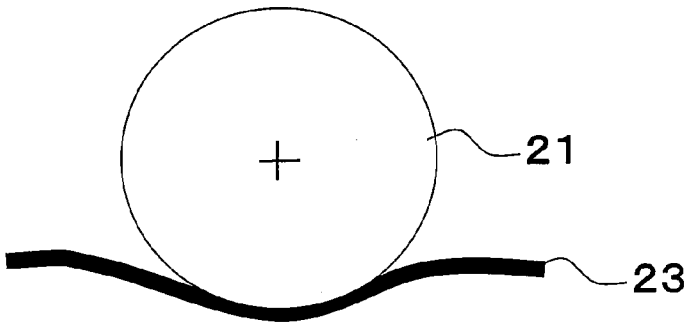
FIG. 8 is a diagram of a contact state of the pressing roller and the heater in the second embodiment.

FIG. 7 is a diagram of a separated state of the first pressing roller 21 and the first heater 23. FIG. 8 is a diagram of a contact state of the first pressing roller 21 and the first heater 23. Since the second pressing roller 22 and the second heater 24 have the same shapes as the first pressing roller 21 and the first heater 23, the first pressing roller 21 and the first heater 23 are explained. Explanation of the second pressing roller 22 and the second heater 24 is omitted.

The first heater 23 is, for example, a flexibly moving heater with a heat transfer member such as an aluminum plate placed between the heater and the first pressing roller 21 or the sheet P. The shape of the first heater 23 changes between during contact and during separation of the first pressing roller 21 and the first heater 23. During the contact of the first pressing roller 21 and the first heater 23, as shown in FIG. 8, the first heater 23 has a concave shape and covers a part of the outer circumference of the first pressing roller 21. During the separation of the first pressing roller 21 and the first heater 23, as shown in FIG. 7, the first heater 23 has a convex shape projecting to the first pressing roller 21 side. Irrespective of the above description, during the contact of the first pressing roller 21 and the first heater 23, the first heater 23 only has to have the concave shape and covers the first pressing roller 21.

During the separation of the first pressing roller 21 and the first heater 23, the first heater 23 may have a flat shape.

The first heater 23 and the second heater 24 have low hardness compared with the first pressing roller 21 and the second pressing roller 22. During the contact of the first pressing roller 21 and the first heater 23, the first heater 23 has the concave shape and covers the first pressing roller 21. The first heater 23 and the second heater 24 are not limited to the flexibly moving heaters with the heat transfer members such as the aluminum plates placed between the heaters and the first pressing roller 21 and the second pressing roller 22 or the sheet P. For example, the first heater 23 and the second heater 24 may be a roller including a heater on the inner side or a belt to which heat is applied by a heater.

According to the second embodiment, during the contact of the first pressing roller 21 and the first heater 23, the first heater 23 has the concave shape and covers the first pressing roller 21. Consequently, it is possible to secure wide and long contact areas of nip portions between the heaters 23 and 24 and the pressing rollers 21 and 22 and efficiently transfer heat to the sheet P.

When the erasing unit 15 is opened to, for example, remove a jammed sheet P and the first pressing roller 21 and the first heater 23 are brought into contact with each other and the second pressing roller 22 and the second heater 24 are brought into contact with each other again to form the nip portions, the positions of the nip portions may shift because of a backlash (clearance) of the pivot shaft 30 and the like. However, according to the second embodiment, the widths of the nip portion formed by the first pressing roller 21 and the first heater 23 and the nip portion formed by the second pressing roller 22 and the second heater 24 can be secured large by the erasing unit 15 explained above. Therefore, even if the positions of the nip portions shift because of the backlash, it is possible to secure the widths of the nip portions large and efficiently transfer heat to the sheet P. The shape of the heaters 23 and 24 is changed between during the contact and during the separation of the pressing rollers 21 and 22 and the heaters 23 and 24. The heaters 23 and 24 cover the pressing rollers 21 and 22 during the contact. Therefore, the first heater 23 easily follows the shape of the first pressing roller 21 and the second heater 24 easily follows the shape of the second pressing roller 22.

With the color erasing apparatus and the erasing method according to the second embodiment, it is possible to secure the widths of the nip portions between the heaters 23 and 24 and the pressing rollers 21 and 22 and efficiently transfer heat to the sheet P. The first heater 23 easily follows the shape of the first pressing roller 21 and the second heater 24 easily follows the shape of the second pressing roller 22. Therefore, it is possible to more efficiently transfer heat to the sheet P and save electric power.

With the color erasing apparatus and the erasing method according to at least one of the embodiments explained above, the heaters are formed in the shape following the pressing rollers. Therefore, it is possible to secure the wide and long contact areas of the nip portions between the heaters and the pressing rollers and efficiently transfer heat to the sheet P.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An erasing apparatus comprising:

a paper feeding unit configured to feed a sheet having an image recorded;

an erasing unit including a pressing roller and a heater having a shape following an outer circumference of the pressing roller and a contact area configured to contact the pressing roller along the outer circumference of the pressing roller, the erasing unit configured to erase the image formed on the sheet fed from the paper feeding unit to a contact section that is between the pressing roller and the contact area of the heater;

a temperature detecting unit configured to detect a temperature of the heater; and a controller configured to control the heater according to the temperature detected by the temperature detecting unit.

2. The apparatus according to claim 1, wherein the pressing roller has a hardness that is greater than a hardness of the heater.

3. The apparatus according to claim 1, wherein the contact area of the heater includes a concave portion that covers a part of the outer circumference of the pressing roller.

4. The apparatus according to claim 1, wherein a shape of the heater changes from a first shape during contact between the pressing roller and the heater to a second shape when and during separation of the pressing roller and the heater are separated.

5. The apparatus according to claim 4, wherein the heater has a concave shape and covers a part of the outer circumference of the pressing roller during the contact between the pressing roller and the heater.

6. The apparatus according to claim 5, wherein the heater has a convex shape projecting towards the pressing roller when the pressing roller and the heater are separated.

7. The apparatus according to claim 4, wherein, when the pressing roller and the heater are separated, a jammed sheet can be removed.

8. The apparatus according to claim 1, wherein the erasing unit includes:

a first erasing unit including the pressing roller and the heater; and a second erasing including a second pressing roller and a second heater arranged in a position relative to each other that is opposite of a corresponding arrangement of the pressing roller and the heater of the first erasing unit, and the erasing unit is configured to erase images on both surfaces of the sheet.

9. The apparatus according to claim 1, wherein the contact area of the heater is flexible.

10. An erasing method comprising:

erasing an image formed on a sheet fed to a contact section between a pressing roller and a contact area of a heater, the contact area of the heater having a shape following an outer circumference of the pressing roller;

detecting a temperature of the heater;

controlling the heater according to the detected temperature; and discharging the sheet on the image is erased.

11. The method according to claim 10, wherein wherein the pressing roller has a hardness that is greater than a hardness of the heater.

12. The method according to claim 10, wherein the contact area of the heater includes a concave portion that covers a part of the outer circumference of the pressing roller.

13. The method according to claim 10, wherein a shape of the heater changes from a first shape during contact between the pressing roller and the heater to a second shape when the pressing roller and the heater are separated.

14. The method according to claim 13, wherein the heater has a concave shape and covers a part of the outer circumference of the pressing roller during the contact between the pressing roller and the heater.

15. The method according to claim 14, wherein the heater has a convex shape projecting towards the pressing roller when the pressing roller and the heater are separated.

16. The method according to claim 13, wherein, the pressing roller and the heater are separated, a jammed sheet is removed.

17. The method according to claim 10, wherein the erasing unit includes:

a first erasing unit including the pressing roller and the heater; and a second erasing including a second pressing roller and a second heater arranged in a position relative to each other that is opposite of a corresponding arrangement of the pressing roller and the heater of the first erasing unit, wherein erasing the image includes erasing images on both surfaces of the sheet.

18. The method according to claim 10, wherein the contact area of the heater flexibly moves.

* * * * *